United States Patent [19]

Mashimo et al.

[11] Patent Number: 4,501,199

[45] Date of Patent: Feb. 26, 1985

[54] AUTOMATICALLY CONTROLLED ROCK DRILLING APPARATUS

[75] Inventors: Tohru Mashimo; Takashi Nishio; Osamu Satoh, all of Hiroshima, Japan

[73] Assignee: Mazda Motor Corporation, Hiroshima, Japan

[21] Appl. No.: 465,652

[22] Filed: Feb. 10, 1983

[30] Foreign Application Priority Data

Feb. 12, 1982 [JP] Japan ..... 57-21871

[51] Int. Cl.[3] ..... F42D 3/00

[52] U.S. Cl. ..... 102/313; 102/312; 299/13; 173/11

[58] Field of Search ..... 102/312, 313; 173/4, 173/11, 43; 299/13

[56] References Cited

U.S. PATENT DOCUMENTS

| | | | |
|---|---|---|---|
| 3,721,471 | 3/1973 | Bergman et al. | 102/313 X |
| 4,040,355 | 8/1977 | Hopler, Jr. | 102/313 X |
| 4,230,189 | 10/1980 | Mashimo | 173/4 |
| 4,246,973 | 1/1981 | Mayer | 173/11 X |
| 4,356,871 | 11/1982 | Fujikawa | 173/11 X |

FOREIGN PATENT DOCUMENTS

| | | |
|---|---|---|
| 54-15401 | 2/1979 | Japan . |
| 54-140706 | 11/1979 | Japan . |

*Primary Examiner*—Peter A. Nelson

*Attorney, Agent, or Firm*—Fleit, Jacobson, Cohn & Price

[57] ABSTRACT

This invention relates to an automatically controlled rock drilling apparatus which performs rock drilling operations as well as post-drilling operations such as explosive charging. Memory means are used during the drilling operation and reused during subsequent operations for follow-up work, specifically the charging of explosive to the drilled bores.

8 Claims, 8 Drawing Figures

AUTOMATICALLY CONTROLLED ROCK DRILLING APPARATUS

The present invention relates to an automatically controlled rock drilling apparatus, and more particularly to a rock drilling apparatus which can perform rock drilling operations as well as post-drilling operations such as explosive charging operations.

Hithertofore, it has already been proposed to control a rock drilling apparatus automatically in accordance with a memory of patterns of bores to be drilled on a rock surface so that the drill bit be placed sequentially against points on the rock surface where the bores are to be formed. For example, in Japanese patent application No. 52-66996 filed on June 7, 1977 and disclosed for public inspection on Feb. 5, 1979 under the disclosure No. 54-15401, there is disclosed a rock drilling apparatus including a drill rod having a drill bit attached to one end thereof and mounted on a guide cell for axial sliding movement. The guide cell is in turn supported on a boom mechanism comprised of a plurality of booms which are interconnected for articulated movements. Power cylinders are provided for controlling the guide cell and the booms so that the drill rod can be moved to any desired positions. The rock drilling apparatus disclosed in the Japanese application includes a control unit having a memory concerning locations in a rectangular coordinates of positions on a rock surface where bores are to be drilled. The control unit functions to address the memory of each position and convert the values in the rectangular coordinates into displacements of the power cylinders to thereby operate the cylinders to locate the drill bit at a desired position. Then, the power cylinder for advancing the drill rod is actuated to perform a drilling operation of a desired depth.

In charging explosives into bores which have thus been formed conventional procedures have been to handle the explosives manually. However, such procedures are dangerous and require highly skilled labours. In order to automate such procedures, there has been proposed to provide an explosive charging pipe which is adapted to be inserted into a bore drilled in a rock surface and through which explosives are charged. For example, Japanese patent application No. 53-48329 filed on Apr. 25, 1978 and disclosed for public inspection on Nov. 1, 1979 under the disclosure No. 54-140706 shows such a type of explosive charging apparatus. In using the explosive charging apparatus, it may be desirable to locate the charging pipe automatically in accordance with the memory which has been used in drilling operation, however, in actual practice, it is impossible to use the memory as it is because the bores are not formed exactly in the positions where the drill bit is located under the function of the control unit. In fact, when the drill rod is advanced for drilling operation, the drill rod may be slightly shifted due to roughness of the rock surface, or the direction of the drill rod may be slightly changed when the drill bit hits to a hard rock layer or a crack in the rock.

It is therefore an object of the present invention to provide a rock drilling apparatus which can perform not only drilling operations but also explosive charging operations automatically in accordance with a memory of pattern of positions where bores are to be drilled.

Another object of the present invention is to provide an explosive charging pipe locating device having means for modifying the memory which has been used in determining the drilling positions so that correct positioning of charging pipe can be made in accordance with the modified memory.

A further object of the present invention is to provide an explosive charging pipe locating means which includes a memory for memorizing the location and the direction of the drilling rod each time when a drilling operation is completed and means for locating the charging pipe taking reference to the memory.

According to the present invention, the above and other objects can be accomplished by a rock drilling apparatus comprising boom means, drilling means adapted to be mounted on said boom means, follow-up work performing means adapted to be mounted on said boom means in lieu of said drilling means for performing a follow-up work after drilling operation, first actuator means for moving said boom means so that said means mounted on the boom means is located against a desired position on a rock surface, second actuator means for advancing and retreating said means mounted on the boom means to perform drilling operations and the follow-up works, detecting means for detecting actual position of said drilling means in a drilled bore upon completion of a drilling operation, first memory means memorizing values in rectangular coordinates of positions on the rock surface where bores are to be drilled, transducing means for converting the values in the rectangular coordinates memorized in the first memory means into values corresponding to positions of said boom means, second memory means memorizing values corresponding to the actual positions of said drilling means in respective ones of the drilled bores upon completion of respective drilling operations, servo control means for operating said first actuator means, selecting means for selecting one of the signals corresponding to outputs from said first and second memory means so that said servo control means is applied with a signal corresponding to said one signal to operate said first actuator means in accordance with said one signal, feedback means for feeding back values of movements of said boom means, to said servo control means, drill control means operable under an output from said servo control means for operating said second actuator means to thereby control movements of said drilling means, processing means for controlling operations of said first and second memory means, said selecting means and said transducing means so that the servo control means is operated under the signal corresponding to the output from said first memory means for the drilling operations and under the signal corresponding to the output from said second memory means for the follow-up works after the drilling operation. The follow-up works may include charging of explosives to the drilled bores as well as forming grooves along the drilled bores so that impacts of explosion are transmitted in desired directions, and also cleaning of the drilled bores. The detection means may include a plurality of proximity switches which are arranged on a guide member for the drill rod so that any displacement and inclination of the drill rod with respect to the guide member can be detected.

The above and other objects and features of the present invention will become apparent from the following descriptions of a preferred embodiment taking reference to the accompanying drawings, in which.

Figure 1:
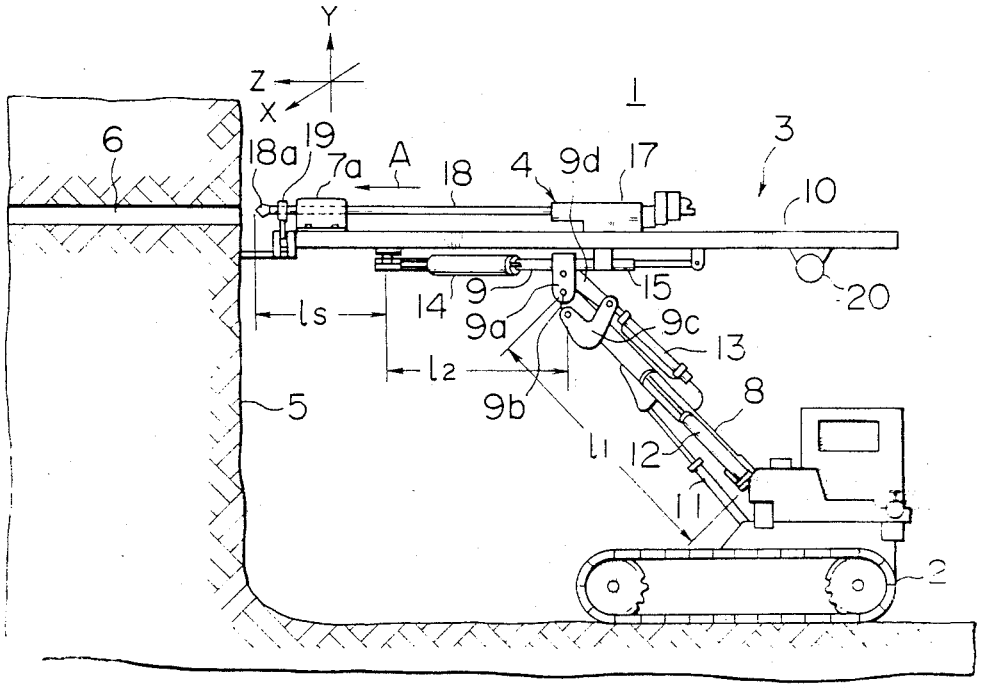
FIG. 1 is a side view of a rock drilling apparatus in accordance with one embodiment of the present invention.
Figure 2:
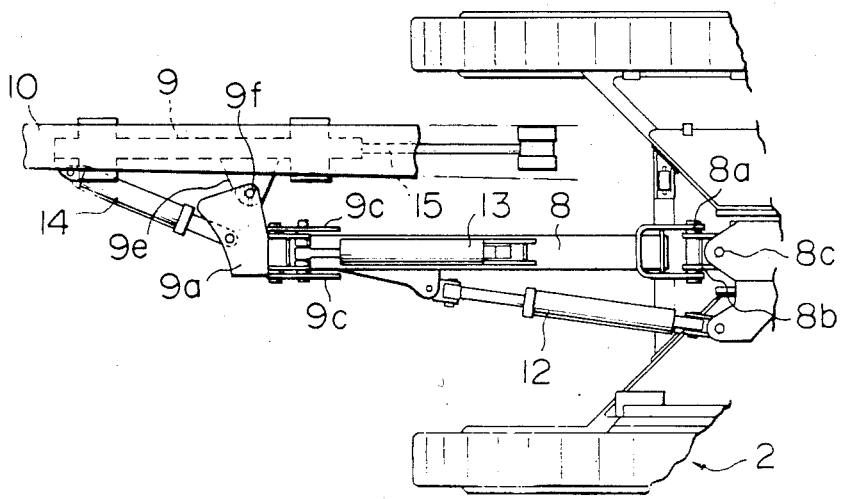
FIG. 2 is a plan view of the rock drilling apparatus shown in FIG. 1.

Referring now to the drawings, particularly to FIGS. 1 and 2, there is shown a rock drilling apparatus 1 including a crawler type vehicle 2 which is provided with a boom mechanism 3 for carrying a drill assembly 4. The boom mechanism 3 includes a first boom 8 connected for swinging movement about a horizontal axis 8*a* with a connecting bracket 8*b* which is in turn mounted on a body of the vehicle 2 for swinging movement about a vertical axis 8*c*. The first boom 8 has a free end provided with a swingable bracket 9*a* which is connected at one end with the boom 8 for swingable movement about horizontal axis 9*b*. A pair of bell-crank arms 9*c* are mounted at one ends to the first boom 8 for swingable movement about a horizontal axis. The other ends of the bell-crank arms 9*c* are connected through a link 9*d* with the bracket 9*a*.

The first boom 8 is associated with a boom lift cylinder 11 for effecting a vertical swinging movement of the boom 8 as well as a boom swing cylinder 12 for effecting a horizontal swinging movement of the boom 8. Between the first boom 8 and the aforementioned other ends of the bell-crank arms 9*c*, there is a cell lift cylinder 13 which functions to control the swinging movement of the bracket 9*a*. As shown in FIG. 2, the bracket 9*a* is pivotably connected by a pin 9*f* with a bracket 9*e* which is secured to a second boom 9. A cell swing cylinder 14 is provided to extend between the bracket 9*a* and the second boom 9 to control the swinging movement about the pin 9*f*. The second boom 9 carries a guide cell 10 so that the guide cell 10 can move longitudinally along the second boom 9. For advancing and retreating the guide cell 10, a cell slide cylinder 15 is provided between the boom 9 and the guide cell 10. The drill assembly 4 includes a drifter 17 mounted on the guide cell 10 and a drill rod 18 extending forwardly from the drifter 17 along the guide cell 10. The drifter 17 is of a known structure and functions to apply an impact force to the drill rod 18. A driving motor 20 is provided to advance and retreat the drifter 17 along the guide cell 10. On the guide cell 10, there is provided a centralizer 19 which serves to guide the drill rod 18. A drill bit 18*a* is provided on the forward end of the drill rod 18. It will therefore be understood that by operating the cylinders 11 through 15 it is possible locate the drill bit against a desired position on a rock surface 5 and to drill a bore 6 by operating the drifter 17 and the motor 20. It will further be understood that the desired position where the drill bit 18*a* be located can be represented by values in rectangular coordinates x, y, z as shown in FIG. 1 and that the coordinates values can be converted to swinging angles of the booms 8 and 9 and a distance $l_s$ of advancement of the guide cell 10.

Figure 8:
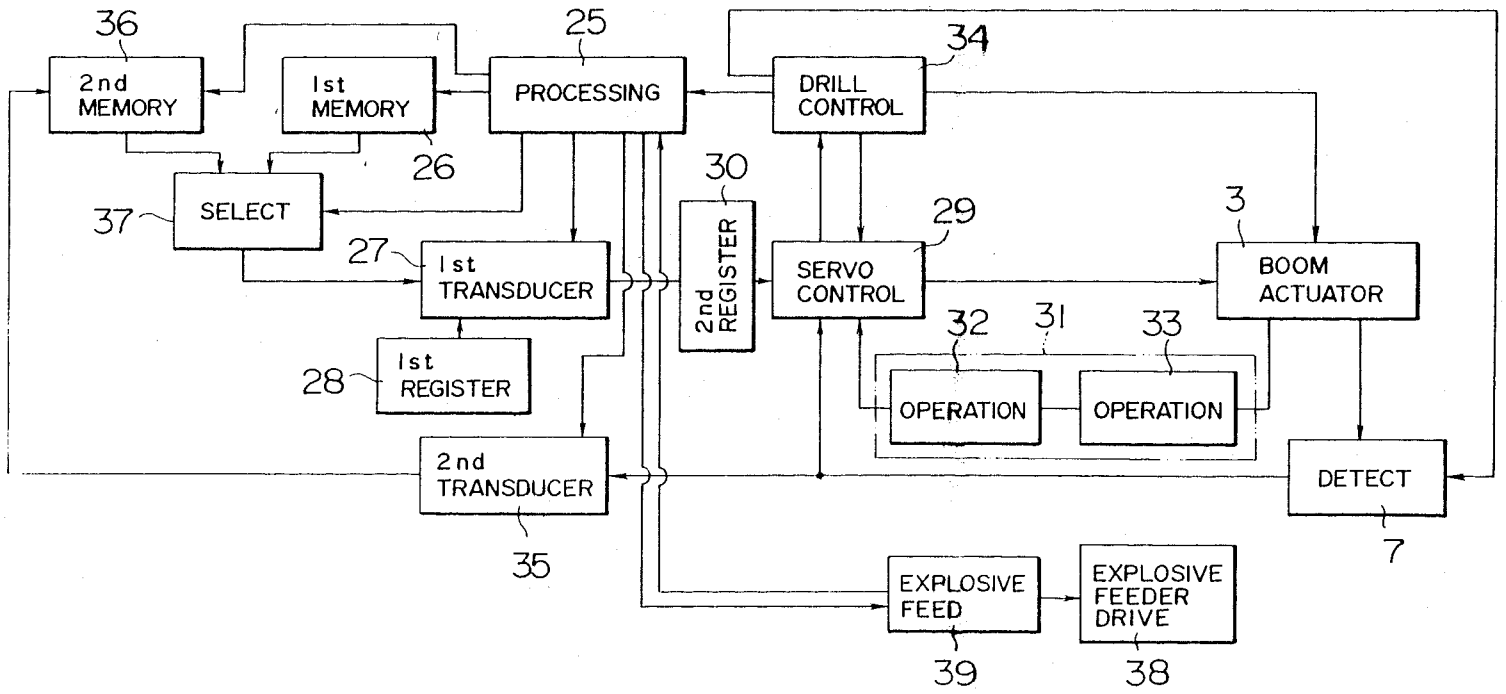
FIG. 8 is a block diagram showing the circuit for controlling the operation of the rock drilling apparatus.

In order for governing the operations of the cylinders 11 through 15 so that the drill bit 18*a* be placed automatically and sequentially at the desired positions against the rock surface 5, there is provided a control circuit as shown in FIG. 8. The circuit includes a first memory circuit 26 which contains memories of the values in the rectangular coordinates of the positions where bores are to be drilled. The output of the first memory circuit 26 is connected through a selecting circuit 37 to a first transducer 27. A processing circuit 25 is provided to apply a signal to the first memory 26 so that the memorized coordinates values of the desired positions are sequentially addressed and applied to the transducer 27. For performing a first drilling cycle, the processing circuit 25 applies a signal to the first memory circuit 26 so that the memorized values corresponding to the first drill position are passed to the selecting circuit 37. The processing circuit 25 further applies a signal to the selecting circuit 37 to have the circuit 37 to pass the signal from the first memory circuit 26 to the first transducer 27. The transducer 27 functions to convert the values in the rectangular coordinates to the swinging angles of the first and second booms 8 and 9 and the distance $l_s$ of advancement of the guide cell 10 taking reference to lengths $l_1$ and $l_2$ of the booms 8 and 9, respectively which applied to the transducer 27 by a first register 28. The output of the first transducer 27 is applied to a second register 30 and the values registered in the second register 30 is used to operate a servo control circuit 29. The servo control circuit 29 functions under the signal from the second register 30 to operate the cylinders 11 through 15 in the boom assembly 3. The movements of the cylinders 11 through 15 are detected by suitable detecting means such as encoders and signals from such detecting means are fed through a feedback circuit 31 including operation circuits 32 and 33 back to the servo control circuit 29 in the form of signals corresponding swinging angles of the booms 8 and 9. The servo control circuit 29 applies its output to a drill control circuit 34 when the drill bit 18*a* is properly located so that the drifter 17 and the motor 20 is operated to drill a bore 6. Thereafter, the motor 20 is operated under the signal from the drill control circuit 34 to pull the drill rod 18 out of the bore 6. Then, the drill control circuit 34 applies a signal to the processing circuit 25 and the processing circuit 25 then applies a signal to the first memory circuit 26 so that the memorized values of a second drill position are addressed. Thus, a second cycle of drilling operation is performed.

Figure 3:
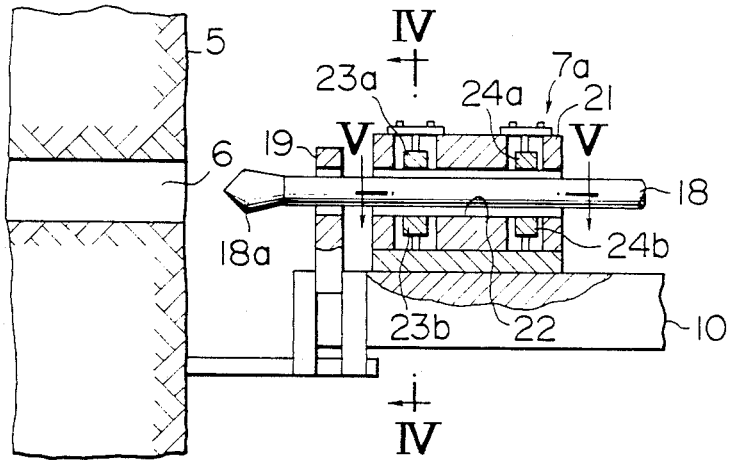
FIG. 3 is a sectional view showing one example of the detecting device.
Figure 4:
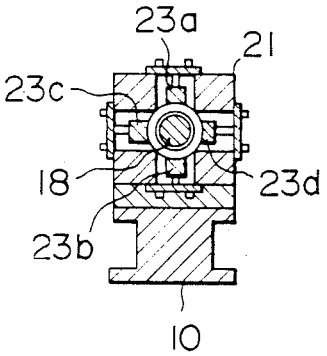
FIG. 4 is a sectional view taken substantially along the line IV—IV in FIG. 3.
Figure 5:
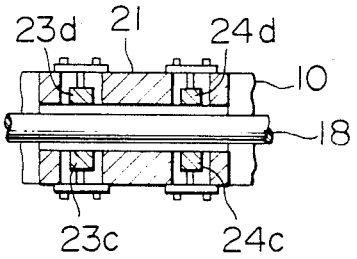
FIG. 5 is a sectional view taken substantially along the line V—V in FIG. 3.

According to the embodiment shown in FIGS. 1 and 2, the guide cell 10 is provided at the forward end portion with a detecting head 7*a* for detecting exact position of the drilling rod 18. As shown in FIGS. 3 through 5, the detecting head 7*a* includes a housing 21 secured to the guide cell 10 and having an axial hole 22 for passing the drill rod 18 therethrough. In the housing 21, there are provided a set of proximity switches 23*a*, 23*b*, 23*c* and 23*d* which are located around the drill rod 18 so as to detect radial displacement of the drill rod 18. Axially spaced apart from the proximity switches 23*a*, 23*b*, 23*c* and 23*d*, there are provided a second set of proximity swtiches 24*a*, 23*b*, 23*c* and 23*d* which are also located around the drill rod 18. In each set, the proximity switches are located so that when the drill rod 18 is coaxial with the axial hole 22 in the housing 21, all of the switches in the set are simultaneously closed or simultaneously opened, whereas when the drill rod 18 is radially offset or displaced with respect to the axial hole 22 in the housing 21, one or some of the switches are closed while the remaining switches are opened. The forward set of switches 23*a* through 23*d* and the rearward set of swtiches 24*a* through 23*d* together functions to detect inclination of the drill rod 18 with respect to the hole 22 in the housing 21.

It will be understood from the above descriptions that if the drill bit 18*a* is radially displaced or the drill rod 18 is inclined from the initially determined position during drilling operation due to conditions in the rock, such displacement or inclination can be detected by the detecting head 7*a*. Referring again to FIG. 8, it will be noted that the control circuit includes a detecting circuit 7 which receives signals from the proximity switches in the detecting head 7 and produces signals corresponding to the movements of the booms 8 and 9. More specifially, in the detecting circuit 7, the signals from the proximity switches 23*a* and 23*b* in the first set are converted to a signal corresponding to a vertical movement of the first boom 8 by the boom lift cylinder 11 whereas the signals from the proximity switches 23*c* and 23*d* are converted to a signal corresponding to a horizontal swinging movement of the first boom 8 by the boom swing cylinder 12. Similarly, the signals from the proximity switches 24*a* and 24*b* are converted to a signal corresponding to a vertical swinging movement of the second boom 9 by the cell lift cylinder 13, and the signals from the proximity switches 24*c* and 24*d* are converted to a signal corresponding to a horizontal swinging movement of the second boom 9 by the cell swing cylinder 14.

The detecting circuit 7 receives a signal from the drill control circuit 34 so that the circuit 7 produces outputs, in each drilling cycle, after the drilling operation is completed but the drill rod 18 is not pulled out of the drilled bore. The outputs from the detecting circuit 7 are applied to the servo control circuit 29 which then produces outputs for operating cylinders 11 through 15 so that the axial hole 22 in the housing 21 of the detecting head 7*a* is placed coaxially with the drill rod 18. Thus, the positions of the booms 8 and 9 are readjusted and the drill rod 18 is pulled out of the bore 6 by operating the motor 20 by the output from the drill control circuit 34. The readjusted positions of the booms 8 and 9 are detected by suitable detecting means such as encoders associated with the cylinders 11 through 15 which may constitute parts of the detecting circuit 7, and the outputs of the detecting means are applied to a second transducer 35 as actual boom position signals. The second transducer 35 functions to convert the actual boom position signals into signals corresponding to values in the rectangular coordinates. The output from the second transducer 35 are then applied to a second memory circuit 36 to be memorized thereby. Thus, the second memory circuit 36 thus contains memories of values in the rectangular coordinates of the actual positions of the drilled bores 6. The second memory circuit 35 has an output connected with the selecting circuit 37 which has been referred to previously.

Figure 6:
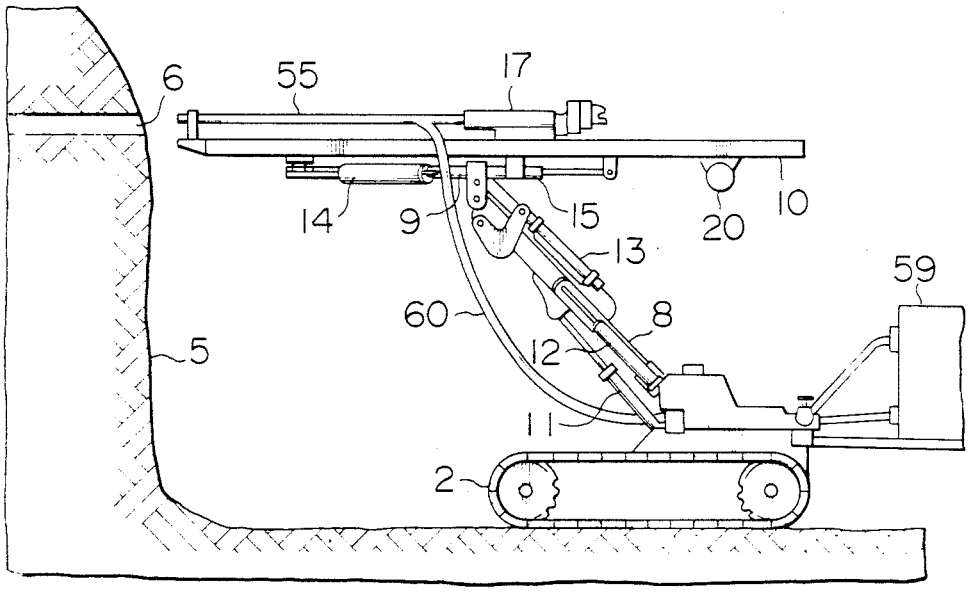
FIG. 6 is a side view of the rock drilling apparatus on which the explosive charging pipe is mounted.
Figure 7:
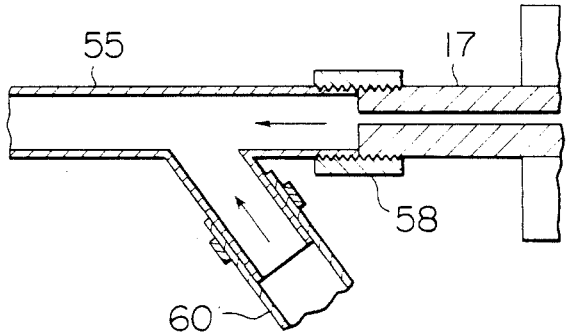
FIG. 7 is a sectional view showing the detail of the explosive charging pipe.

Referring now to FIG. 6, it will be noted that the drilling rod 18 on the guide cell 10 is substituted by an explosive charging pipe 55 which is connected at one end with the drifter 17 by means of a joint sleeve 58 as shown in FIG. 7. The pipe 55 is connected at an end adjacent to the drifter 17 with a hose 60 leading from an explosive feeder 59 provided on the vehicle 2. In charging explosives into the bore 6, the charging pipe 55 is inserted into the bore 6 and explosives are supplied through the hose 60 and the pipe 55 to the bore 6 under a pneumatic force. In inserting the charging pipe 55 into the bore 6 for the purpose, the position and direction of the charging pipe 55 are determined by the control circuit. Thus, the processing circuit 25 applies a signal to the selecting circuit 37 so that the memories in the second memory circuit 36 is sequentially addressed and passed to the first transducer 27 to thereby control the operations of the boom actuating cylinders 11 through 15 under the memories in the second memory circuit 36. Since the second memory circuit 36 contains memories of the actual positions in the drilled bores of the drilling rod 18 after drilling operation are completed, it is possible to locate the charging pipe 55 exactly against the drilled bore 6. Then, the drill control circuit 34 functions to operate the advancing motor 20 to advance the drifter 17 and the charging pipe 55 to thereby insert the pipe 55 into the bore 6.

As shown in FIG. 8, the control circuit includes an explosive feed circuit 39 which is operated by a signal from the processing circuit 25 to produce a signal which is applied to an explosive feeder drive circuit 38 after the charging pipe 55 is inserted into the drilled bore 6. The output of the drive circuit 38 serves to operate the explosive feeder 59 so that explosives are fed through the hose 60 and the charging pipe 55 into the drilled bore 6. After the explosives are thus charged in the bore 6, the charging pipe 55 is pulled out of the bore 6 by actuating the motor 20 by the output from the drill control circuit 34 to complete one explosive charging cycle. Then, the cylinders 11 through 15 are operated in accordance with the memories in the second memory circuit 36 corresponding to the position of the second bore 6 to locate the charging pipe 55 against the second bore 6 and a second cycle of explosive charging operation is performed. In this manner, explosives are sequentially charged in all of the drilled bores automatically in accordance with the memories in the second memory circuit 36. It will be noted that the signals from the detecting circuit 7 may not necessarily by converted into values in the rectangular coordinates but may be memorized directly by the second memory circuit 36. In the case, the selecting circuit 37 should be provided between the output of the first transducer 27 and the output of the second memory 36 so that the output of the first transducer 27 and the output of the second memory 36 are selectively applied to the second register 30.

The invention has thus been shown and described with reference to a specific embodiment, however, it should be noted that the invention is in no way limited to the details of the illustrated embodiment but changes and modifications may be made without departing from the scope of the appended claims.

We claim:

1. A rock drilling apparatus comprising boom means, drilling means adapted to be mounted on said boom means, follow-up work performing means adapted to be mounted on said boom means in lieu of said drilling means for performing a follow-up work after drilling operation, first actuator means for moving said boom means so that said means mounted on the boom means is located against a desired position on a rock surface in a desired direction, second actuator means for advancing and retreating said means mounted on the boom means to perform drilling operations and the follow-up works, detecting means for detecting actual position and direction of said drilling means in a drilled bore upon completion of a drilling operation, first memory means memorizing values of rectangular coordinates of positions on the rock surface where bores are to be drilled, transducing means for converting the values in the rectangular coordinates memorized in the first memory means into values corresponding to positions of said boom means, second memory means memorizing values corresponding to the actual positions and directions of said drilling means in respective ones of the drilled bores upon completion of respective drilling operations, servo control means for operating said first actuator means, selecting means for selecting one of the signals corresponding to outputs from said first and second memory means so that said servo control means is applied with a signal corresponding to said one signal to operate said first actuator means in accordance with said one signal, feedback means for feeding back values of movements of said boom means to said servo control means, drill control means operable under an output from said servo control means for operating said second actuator means to thereby control movements of said drilling means, processing means for controlling operations of said first and second memory means, said selecting means and said transducing means so that the servo control means is operated under the signal corresponding to the output from said first memory means for the drilling operations and under the signal corresponding to the output from said second memory means for the follow-up works after the drilling operation.

2. A rock drilling apparatus in accordance with claim 1 in which said detecting means includes operation circuit means for producing actual bore position and direction signals corresponding to positions and directions of said boom means.

3. A rock drilling apparatus in accordance with claim 2 which further includes second transducing means for converting said actual bore position and direction signals from said detecting means into values in said rectangular coordinates, said second transducing means having an output connected with the second memory means so, that output of the second transducing means is memorized in the second memory means, said selecting means being located to selectively pass one of outputs from said first and second memory means to said first transducing means.

4. A rock drilling apparatus in accordance with claim 1 in which said follow-up work performing means is explosive charging means having charging pipe means adapted to be inserted into a drilled bore.

5. A rock drilling means in accordance with claim 1 in which said boom means includes first boom means mounted on a body of the apparatus for vertical and horizontal swinging movements, second boom means mounted on said first boom means for vertical and horizontal swinging movements and guide cell means mounted on said second boom means for axial sliding movement thereon, said guide cell means being adapted to mount said drilling means and said follow-up work performing means, said first actuating means including actuators for effecting said vertical and horizontal swinging movements of said first and second boom means and said axial sliding movement of said guide cell.

6. A rock drilling apparatus in accordance with claim 1 in which said detecting means includes a first set of proximity switches arranged so as to detect radial displacement of said means mounted on said boom means at one axial position and a second set of proximity switches arranged so as to detect radial displacement of said means mounted on said boom means at another axial position.

7. A rocking drilling apparatus in accordance with claim 6 in which each of said first and second sets of proximity switches includes at least four switches located above and beneath and at both sides of said means mounted on said boom means.

8. A rock drilling and follow-up work performing method for drilling a bore in a rock surface and for performing follow-up work within said drilling bore, said method employing a rock drilling apparatus having a movable boom with a means for selectively attaching a drilling apparatus and a follow-up work performing apparatus thereto, and electronic control means for automatically moving the boom and actuating the drilling apparatus and follow-up work performing apparatus to move such apparatus in accordance with values stored in a control means electronic memory, the method comprising the steps of:

storing in memory the desired position and direction coordinates of the drilling apparatus;

moving the boom and positioning the drilling apparatus adjacent a rock surface in accordance with the desired position and direction coordinates stored in memory;

actuating the drilling apparatus to drill a bore in the rock surface;

detecting and storing, in memory, values corresonding to the actual position of the drilling apparatus following the completion of the actuating step;

removing the drilling apparatus from the bore;

substituting the follow-up work performing apparatus for the drilling apparatus;

moving the boom and positioning the follow-up work performing apparatus in accordance with the values corresponding to the actual position of the drilling apparatus stored in memory; and actuating the follow-up work performing apparatus.

* * * * *